United States Patent [19]

Norman

[11] 4,389,139

[45] Jun. 21, 1983

[54] OSCILLATING JET HEAD UNDERWATER TRENCHING APPARATUS

[76] Inventor: Robert M. Norman, 128 Nickelson Pkwy., Lafayette, La.

[21] Appl. No.: 188,923

[22] Filed: Sep. 19, 1980

[51] Int. Cl.[3] ..... E02F 5/02

[52] U.S. Cl. ..... 405/163; 405/161; 405/162

[58] Field of Search ..... 405/158–164; 37/61–63

[56] References Cited

U.S. PATENT DOCUMENTS

| | | | |
|---|---|---|---|
| 2,602,300 | 7/1952 | Collins | 405/163 |
| 3,004,392 | 10/1961 | Symmank | 405/163 |
| 3,505,826 | 4/1970 | Harmstorf | 405/163 |
| 3,877,237 | 4/1975 | Norman | 405/163 X |
| 4,041,717 | 8/1977 | Dressel et al. | 405/163 |
| 4,112,695 | 9/1978 | Chang et al. | 405/163 |
| 4,117,689 | 10/1978 | Martin | 405/163 |
| 4,280,289 | 7/1981 | Bassompierre-Sewrin | 405/163 X |

*Primary Examiner*—Dennis L. Taylor

*Attorney, Agent, or Firm*—Francis A. Keegan

[57] ABSTRACT

This invention relates to the self-propelled underwater trenching apparatus and method for burying pipelines, cables and the like with minimum underwater diver supervision. The apparatus includes a frame having frame members positioned about the pipeline and buoyancy tanks with variable positions. Drive rollers are connected to the frame members for drive engagement with the pipeline. The frame members are movable by power rams about vertical and horizontal pivots selectively to engage or disengage the drive rollers with the pipeline. Oscillating water jet nozzles are secured to the apparatus for preselected sweeping movement to cut away the bottom formation to enable the pipeline to be buried in the trench so formed. To aid in the forming of the trench by removing the cuttings, an eductor is positioned over the pipeline in front of the front jet nozzles, an air dispersal ring and water jet nozzles are combined with rear eductors and an optional shroud is positioned over the frame to confine the cuttings for easier removal.

To prevent contact with the sides and bottom of the trench both the jet nozzles and the buoyancy tanks are vertically movable. Upon meeting an obstruction on the surface of the pipeline, power rams in the fore portion of the frame member pivot the frame member about vertical and horizontal pivots to bring the forward drive rollers out of driving engagement and then back into driving engagement after being driven over the obstruction by the rear drive rollers.

65 Claims, 8 Drawing Figures

OSCILLATING JET HEAD UNDERWATER TRENCHING APPARATUS

BACKGROUND OF THE INVENTION

This invention relates generally to a self-propelled underwater trenching apparatus. More particularly the present invention is concerned with the self-propelled underwater buoyant apparatus for burying pipelines or cables and the like in a trench formed in the bottom of a body of water. Uniquely, the present invention further relates to an underwater apparatus for burying pipelines or cables by cutting a trench in the bottom formation and overcome any obstruction on the pipeline to the continuous movement of the apparatus along the pipeline formation and disposing of the cuttings so produced.

DESCRIPTION OF PRIOR ART

In U.S. Pat. Nos. 3,926,003, 3,877,237 in the name of the present inventor, there is disclosed an apparatus for burying pipelines, cables and the like in the bottom formation of a body of water. The apparatus therein disclosed utilizes high pressure fluid in the form of water jets positioned in advance of the movement of the apparatus along the pipeline to cut away a trench in the bottom formation into which the pipeline will rest. This prior art apparatus was designed to be supported by the pipeline to be buried and propelled along the pipeline by a propulsion system utilizing resiliently urged drive rollers. The drive rollers were held on a frame structure positioned on each side of the pipeline. In order to reduce the weight of the trenching apparatus on the pipeline, buoyancy tanks were provided to provide a buoyant effect that was an aid in minimizing the possible damage to any coating on the pipeline due to the weight of the apparatus and the rotation of the drive rollers. The formation was cut by a plurality of stationary water jet nozzles positioned in the fore portion of the apparatus on each side of the pipeline for spraying cutting water jets in selected directions. Eductors were positioned aft and below of the jet means and pipeline to suck up the cuttings and other debris that have formed in the trench by the jets. Other eductor tubes are disclosed in U.S. Pat. No. 3,368,358. The stabilizing means in the form of buoyancy tanks are stationary on the frame.

This patented apparatus, although successful commercially in the past, is no longer in use because it possessed inherent limitations in its operation and more importantly required diver supervision to overcome various pipeline and trench formation conditions.

One of the pipeline conditions that caused great difficulty in achieving continuous operation was that prior art trenching apparatus would not effectively and efficiently pass over such various obstructions such as anodes in the surface of the pipeline. In instances of such obstruction, the diver must release one or more of the rollers or shift the position of the apparatus and then guide the apparatus along the pipeline until the obstruction is passed. Failure to release the apparatus from the pipeline usually results in damage to the pipeline, the coating on the anode positioned on the pipeline or each of them.

In Applicant's copending application Ser. No. 008,849 filed Feb. 2, 1979, a continuation of Ser. No. 829,350 filed Aug. 31, 1977 disclosed and claimed an underwater self-propelled trenching apparatus capable of overriding obstructions such as anodes positioned on the pipeline surface without requiring the presence of a diver or without causing damage to the pipeline and its coating. This apparatus selectively powered a forward power means such as a ram and alternately an aft power means to open and close selectively and alternately the fore and aft portions of the frame in order to selectively and alternately engage and disengage the drive rollers from the pipeline. When operated in the manner intended, the apparatus disclosed in this copending application permits the apparatus to come upon an anode and open the fore portion of the frame to disengage the fore rollers while the aft rollers are continuously powered to move the apparatus along the pipeline to a point where the fore rollers have overridden the obstruction. The fore power means then closes and the fore drive rollers engage the pipe while the aft power means opens the aft portion of the frame to disengage the rear rollers. The fore drive rollers then power the apparatus forwardly along the pipeline until the aft rollers clear the obstruction at which time the aft power means closes the frame to reengage the aft drive rollers in order that the apparatus may continue with all drive rollers engaged to continue down the pipeline. During this period the cutting means in the form of water jets are continuously operating to cut the trench from the bottom formation.

There is minimum need for diver supervision to attend to the usual and anticipated obstructions positioned along the pipeline.

U.S. Pat. No. 4,022,028 issued to Charles F. Martin discloses an underwater trenching apparatus having resiliently urged drive wheels and rotating jet nozzles.

The design of the Applicant's prior apparatus was successful in burying pipeline. However it was desirable to form the trench more quickly than possible with the water jets previously known which allowed no control of the jets particularly with respect to their period and sweep. Thus, it has been found that the harder formations often posed more difficulty in forming the trench and achieving desirable progress toward burying the pipeline than was economically acceptable.

In practice it had been found that the forward progress of the underwater trenching apparatus often was retarded due to the effect of the cuttings from the formation. These cuttings of various sizes had often been found to clog the eductors or to be massed about the apparatus when not properly disposed of and prevent further movement. The size and shape of the trench and the type of formation into which it is cut has a very significant effect upon the progress of the apparatus not only when the formation is of hard material but also when the softer formation having little inherent stability is cut. Such unstable formations have often been found to cave in the sides after the cutting jet nozzles have cut the formations requiring a reversal of the progress of the apparatus and then a repeat forward motion to pass over the same area containing the cave-in.

In practice there have been a variety of improvements that could be made in the underwater trenching apparatus to refine its operation and accelerate its progress down the pipeline with minimum loss of time.

OBJECTS OF THE INVENTION

It is the principal object of the present invention to provide a self-propelled underwater trenching apparatus for burying pipelines, cables and the like which minimizes the requirement of underwater supervision of a diver to enable effective and efficient operation of the trenching apparatus.

It is also an object of the present invention to provide underwater self-propelled trenching apparatus capable of overriding obstructions such as anodes positioned along the pipeline without requiring the presence of a diver or damaging the pipeline or the coating.

This invention also has an object the provision of underwater self-propelled trenching apparatus that effectively and efficiently cuts a bottom formation to permit improved forward progress of the apparatus along the pipeline.

Another object of the present invention is to provide a self-propelled underwater trenching apparatus in which the cuttings from the bottom formation forming the trench are disposed of with minimum impedence of the forward progress of the apparatus along the pipeline.

Another more limited object of the present invention is to provide a self-propelled underwater trenching apparatus for burying pipelines in which the frame of the apparatus incorporates a journal in the frame to achieve limited rotational movement about an axis substantially perpendicular to the pipeline in order to permit the fore and aft drive rollers to selectively and alternately engage and disengage from the pipeline.

A further object of the present invention is to achieve maximum cutting of the formation by providing oscillating jet nozzles having a preselected period and sweep.

A further object of the present invention is to provide a self-propelled underwater trenching apparatus for burying pipelines in which the cuttings of the bottom formation are confined within an area related to the size of the frame of the apparatus.

A further and more particular object of the present invention is to effect disposal of the cuttings through the use of a shroud means around the frame of the apparatus and the positioning of an outlet means in the shroud for the cuttings to be removed to prevent the cuttings from falling back into the trench area.

A further object of the present invention is the provision of a self-propelled underwater trenching apparatus in which the eductors for disposal of the cuttings are provided with a cuttings disposal means communicating with the eductor to facilitate removal of the cuttings through the eductor.

It is also an object of the present invention to provide buoyancy means for stabilizing the self-propelled underwater trenching apparatus and to permit the vertical movement of the buoyancy means relative to the frame of the apparatus.

A further and more limited object of the present invention is to provide jet nozzle protectors surrounding selected jet nozzles to prevent contact between the nozzle and the formation.

These and other objects of the present invention shall become more apparent upon careful study of the following detailed description and appended claims including the following drawings:

THE DRAWINGS

SUMMARY OF THE INVENTION

The self-propelled underwater trenching apparatus for burying pipelines, cables and the like is provided with a frame and frame members positioned over the pipeline. The frame members are movable by power rams through a journal about an axis perpendicular to the pipeline and also movable about a horizontal pivot selectively and alternately to engage and disengage drive rollers with the pipeline. The bottom formation is cut more effectively with oscillating water jet nozzles in a preselected pivotal movement with controllable period and sweep to cut the trench into which the pipeline is to be buried. A forwardly positioned eductor is situated over the pipeline forward of the forward jet nozzles to permit the apparatus to reverse direction and move forward in the event of side cave-ins of the trench. Cutting disposal means in the form of an air dispersal ring and a water jet nozzle are combined with the eductors to prevent the cuttings from limiting the forward progress of the apparatus. To aid in the disposal of the cuttings an optional shroud is positioned over the frame to combine the cuttings in the area of the frame to be removed from outlets in the shroud and dispersed away from the trench. In order to minimize the hindrance of the sides of the trench being cut contacting the stabilizing means the buoyancy tanks forming the stabilizing tanks are vertically movable with respect to the frame member.

DESCRIPTION OF THE PREFERRED EMBODIMENT

General Description

Figure 1:
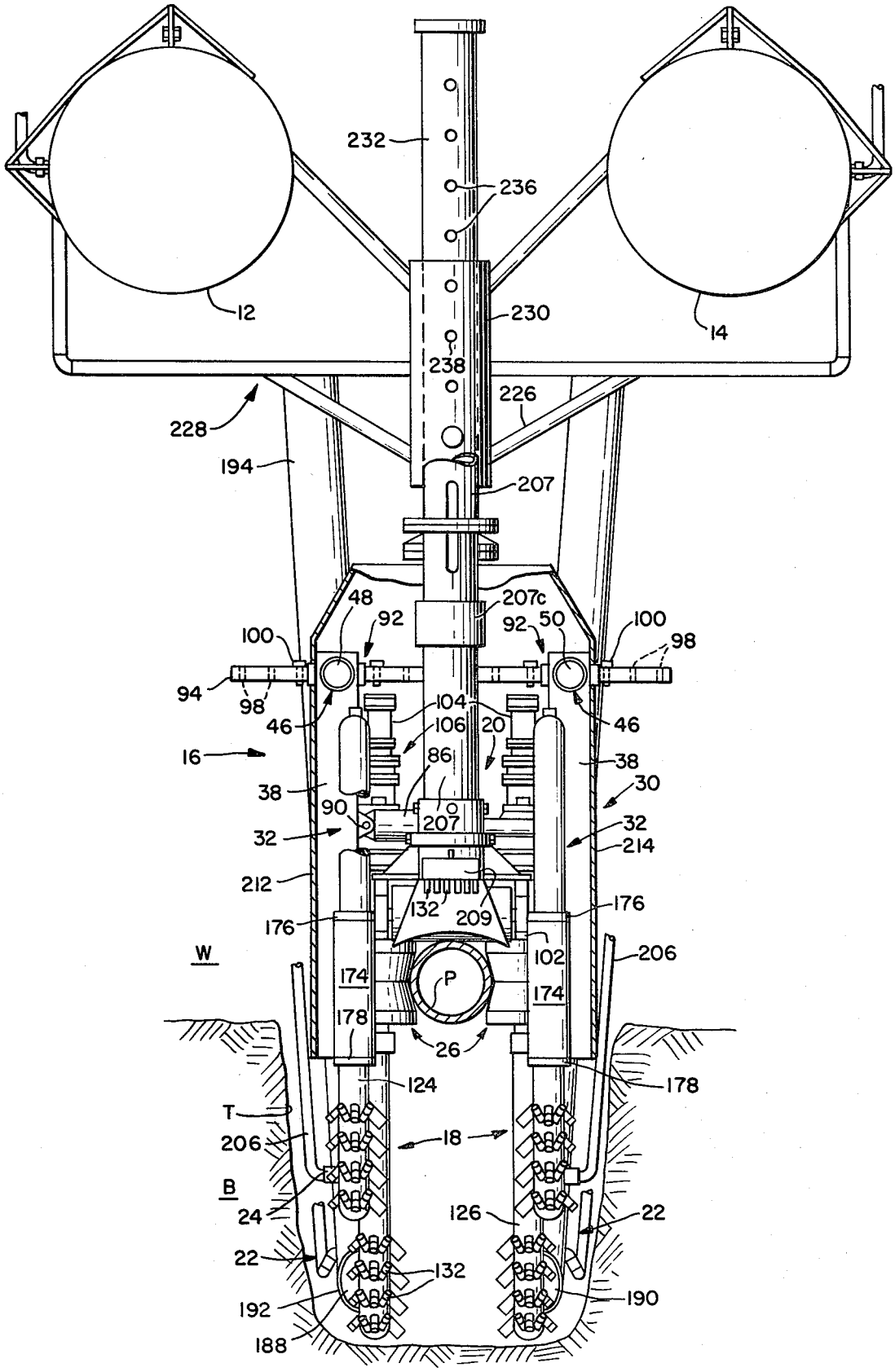
FIG. 1 is a front elevational view in section and partly broken away illustrating the positioning of the underwater trenching apparatus along the pipeline and the positioning of the forward eductor means.
Figure 2:
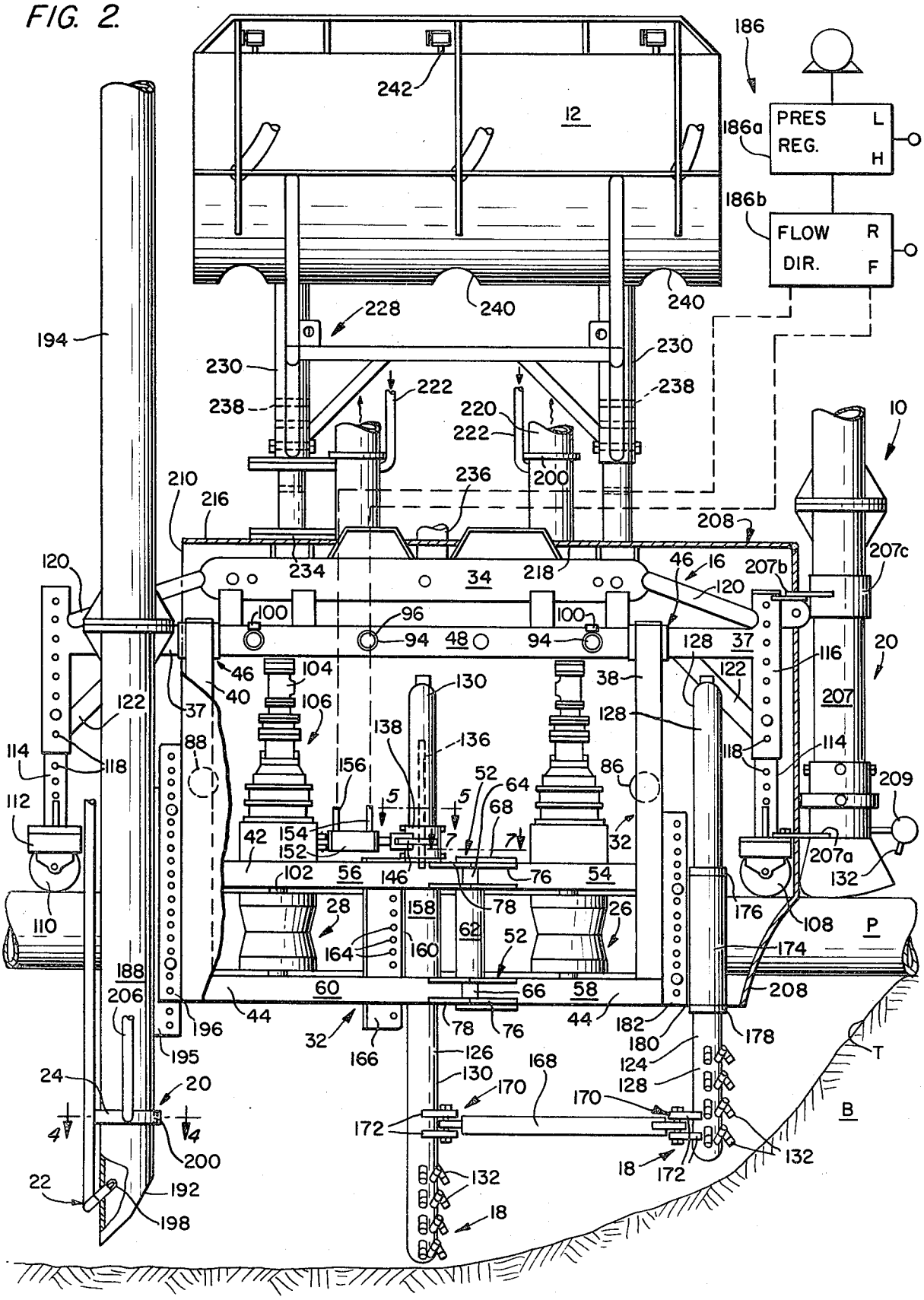
FIG. 2 is a side elevational view partly broken away illustrating the positioning of the buoyancy tanks, drive rollers, oscillating cutting jets, forward eductor means and the cuttings disposal means.

FIGS. 1 and 2 of the drawing disclose generally the self-propelled underwater trenching apparatus 10 constituting the present invention. The apparatus 10 is positioned over pipeline P to be buried in the trench T formed by the trenching apparatus in the bottom B of a body of water W. The apparatus proceeds in the direction of the arrow shown in FIG. 2 while cutting the trench and burying the pipeline P previously laid on the bottom B of the body of water. As the trench is cut from the bottom formation the pipeline behind the apparatus 10 falls into the trench and is backfilled by the cutting debris as well as the water currents to bury the pipeline. A barge or slip (not shown) is on the surface above the trenching apparatus to supply power and fluids required by the apparatus and to provide various other control and recording procedures in order to direct the progress of the apparatus and to determine the efficiency and effectiveness of the burying. The self-propelled underwater trenching apparatus of the present invention is a composite apparatus formed of several entities. The stability of the trenching apparatus as it is positioned over the pipeline P and its buoyancy is controlled by the buoyancy tanks 12 and 14 positioned above and astride the apparatus 10.

A frame 16 forms generally the support of the apparatus and is in a generally inverted U-shape to be positioned on each side of the pipeline P. Supported on the frame 16 are a plurality of formation cutting jet means 18 positioned to achieve the most efficient and effective cutting of the formation. Eductor means 20 positioned both fore and aft of the apparatus are designed to remove the cuttings from the formation. Selected eductors are fitted with particular cuttings dispersal means 22 and 24 to provide positive assistance to dispose of the cuttings. The apparatus is propelled along the pipeline by fore and aft drive rollers 26 and 28 respectively. To assist further the disposal of the cuttings and optional shroud 30 is connected to the frame 16.

THE FRAME STRUCTURE

The underwater trenching apparatus 10 of the present invention has a support skeleton in the form of frame 16 having an inverted U-shape and composed of a plurality of frame members 32 forming the inverted U positioned over the pipeline. Secured to the frame to impart greater structural rigidity is a manifold 34 supplying air pressure by a suitable pipe (not shown) connected to the inlet 36 of the manifold. The size of the manifold 34 is not critical. However its shape for purposes of rigidity is preferably but not necessarily in the form of a cylindrical steel tube closed at the end.

The frame members 32 forming the frame 16 include a stationary spine 37 to which the manifold 34 is secured, elongated tubular upright beam members positioned in fore and aft pairs 38 and 40, an upright beam member of each pair being on each side of the pipeline P. Connected between the upright beam members 38 and 40 are upper and lower bars 42 and 44 on each side of the pipeline suitably connected to the upright beam members 38 and 40 to form support for the fore and aft drive rollers 26 and 28. At the upper end of each beam member 38 and 40 there is a bearing 46. Journaled within the bearing 46 to permit pivotal movement of the frame members about the horizontal axis formed by the bearing 46 are tubular pivot shafts 48 and 50 extending parallel to the spine 37 and to the pipeline P on each side thereof the length of the apparatus. The frame members 32 except spine 37 but including the upright beam members 38 and 40 and the upper and lower bars 42 and 44 and to which the fore and aft drive roller means 26 and 28 are attached are pivotable about their respective pivot shafts 48 and 50.

Figure 6:
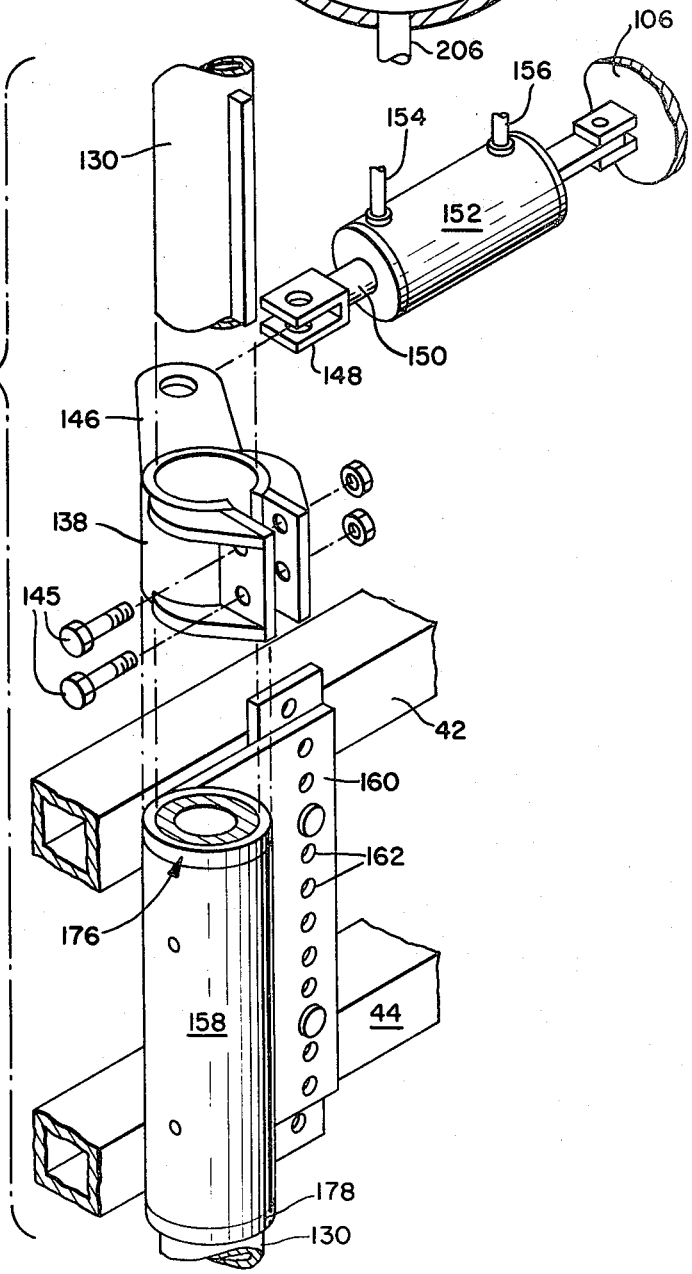
FIG. 6 is an exploded perspective view partly broken away showing the oscillating mechanism.
Figure 7:
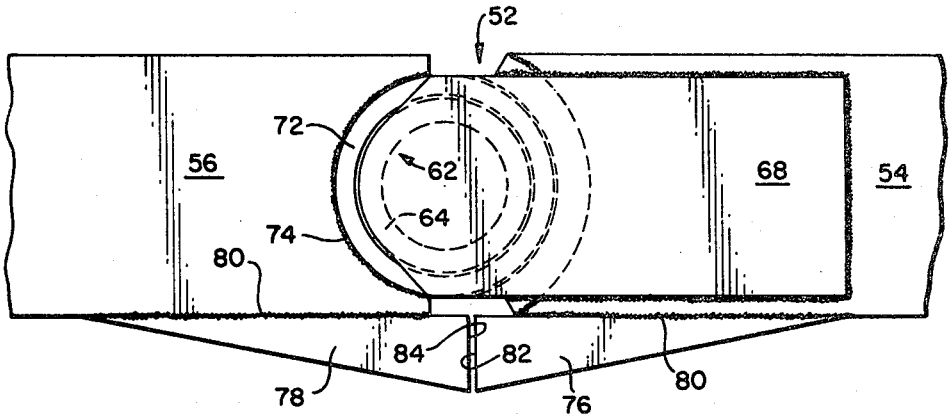
FIG. 7 is a top view taken along lines 7—7 of FIG. 2 and illustrating the top of the journal means for moving the frame member to an open and closed position.
Figure 8:
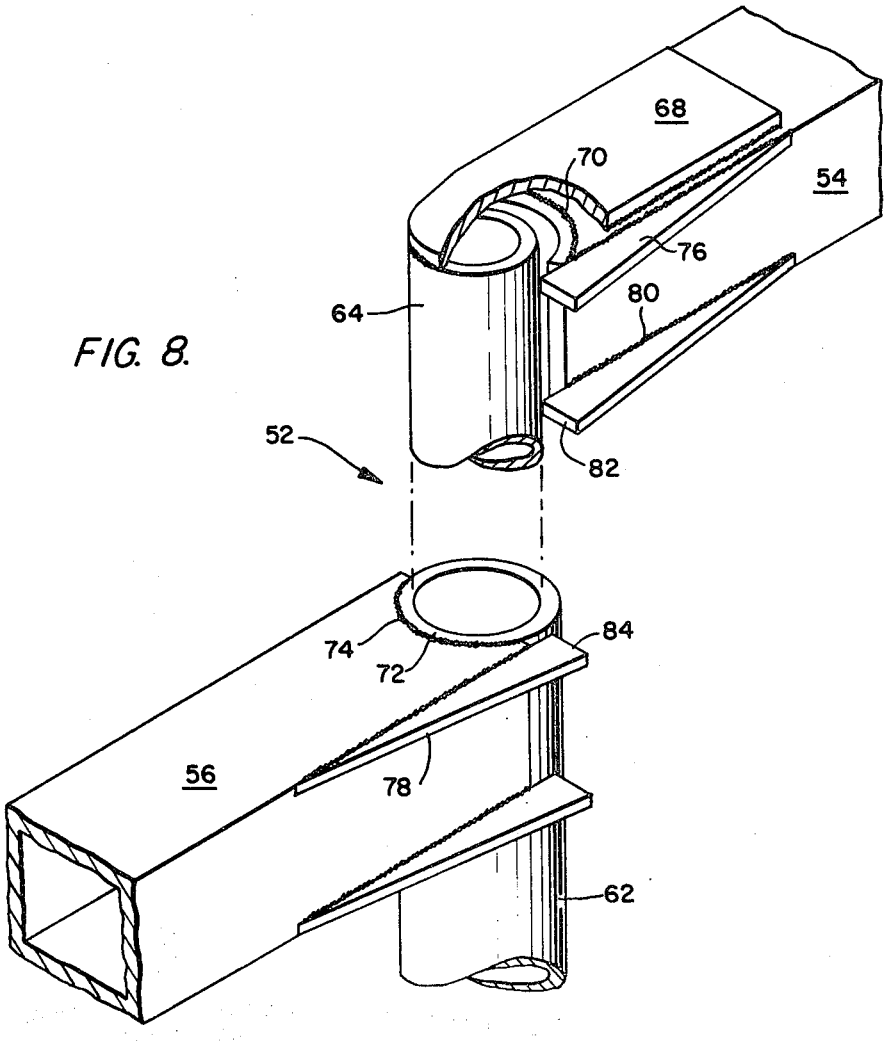
FIG. 8 is a perspective view partly broken away illustrating the journal means and the abutments.

Each of the upper and lower bars 42 and 44 connected between the upright beam members 38 and 40 is provided with journal means 52 as best shown in FIGS. 2, 6 and 7. The journal means 52 forms a vertical pivotal axis perpendicular to the axis of the pipeline and is formed between each upper and lower bar 42 and 44 to form fore and aft sections 54 and 56 of the upper bar 42 and 58 and 60 from the lower bar 44. Positioned between the fore and aft sections of the upper and lower bars 42 and 44 is shaft 62 having a journal 64 and 66 at each end. As best shown in FIG. 7 and using the fore and aft sections 54 and 56 as an example, the journal 64 is welded to top plate 68 which in turn is welded at 70 to the fore section 54. The journal 64 formed on the upper end of shaft 62 pivots within bearing 72 welded at 74 to the aft section 56. Complementary abutments 76 and 78 are suitably secured as by welding to the fore and aft sections of each of the upper and lower bars 42 and 44. As shown the abutment plates are triangular in shape and have abutting surfaces 82 and 84 on their respective abutment plates 76 and 78 which limit the relative pivotal movement between sections 54 and 56.

The power means for separating the frame members is positioned between the vertical beam members 38 and 40 in the form of double acting fore and aft rams 86 and 88 that may have a pinned rod and yoke connection to the upright beam members as shown at 90. This connection 90 permits some angular movement between the beam members and the end of the rod through the connection 90. Ram 86 is positioned in the forward end of the apparatus and transversely contacts the fore portion of the frame member 38 while ram 88 is positioned in the aft end of the apparatus and operates independently on the aft upright beam member 40.

The rams 86 and 88 may be suitably powered in any manner but preferably are operated hydraulically through suitable hydraulic hose connections (not shown) and connected to a ram actuator (also not shown) which operates to selectively actuate ram 86 and 88 to open or close the frame members by pivoting about the horizontal pivot shaft 48 and 50 and also to actuate the pivotal movement about journal means 52 to open the close the fore sections 54 and 58 of upper and lower bars 42 and 44 respectively and aft sections 56 and 60 of the same upper and lower bars. Suitable control mechanism extending to the surface enables the crew on the barge to open or close independently the forward ram 86 or aft arm 88.

Abutment plates 76 and 78 will limit the inward movement of the fore and aft sections upon a closing force being applied by either the forward ram or the aft ram.

The frame members 32 such as the upper and lower bars 42 and 44 and upright beam members 38 and 40 are movable not only about the pivot shafts 48 and 50 and the journal means 64 and 66 but these frame members as well as the pivot shafts 48 and 50 are laterally extensible by telescopic means 92 extending from spine 37 transversely to the axis of the pipeline to be received by the pivot shafts 48 and 50 in both the fore and aft positions of the apparatus as best shown in FIGS. 1 and 2. Each telescopic means 92 is composed of a plurality of transverse rods 94 connected at one end to spine 37 and at the other end received into elongated sleeves 96 fitted transversely within the pivot shafts 48 and 50. The transverse rods 94 maintain a loose slideable relationship with the elongated sleeves 96. Suitable positioning and retaining means such as a plurality of bores 98 into which pins 100 may be placed are utilized to maintain the position of the transverse rod 94 relative to the sleeve 96. The transverse position of the frame members 32 relative to the axis of the pipeline is thus determined. The positioning of the frame members 32 is preselected and limited only by the diameter of the pipeline.

DRIVE ROLLERS AND PROPULSION SYSTEM

The drive rollers constitute the fore and aft pairs of drive rollers 26 and 28. Each roller of each pair being essentially identical. The rollers are designed to be engaged and disengaged in contact with the pipeline for driving relationship. Each roller is positioned between the upper and lower bars 42 and 44 and are suitably journaled for rotation by means of shafts 102. The shafts 102 extend above the upper bar 42 and are suitably journaled for rotation in bearings not shown. The rollers are limited to rotation movement within the journal and are moved only by movement of the frame members in order to engage and disengage from driving relationship with the pipeline.

The drive rollers 26 and 28 are rotated by a fluid actuated motor 104 of conventional design. The fluid motors 104 are connected to the drive rollers through gearing 106. The control of the operation of the fluid motors and therefore the control of the fore and aft pairs of drive rollers 26 and 28 may be as set forth in my copending application identified above or may be any of the conventional means that permits the fore and aft pairs of drive rollers to be operated independently of the other pair. The position of the drive rollers within the frame is preferably as shown in FIG. 2 wherein the forward drive rollers 26 are positioned between the forward and aft pairs of jetting means 18. The positioning of the drive roller in such a location enables the drive roller to follow the pipeline unimpeded along the clear, shallow trench formed by the forward jet cutting means and guide the apparatus along any pipeline curvature. Aft position jet cutting means cut the formation deeply to form the trench precisely along the path of the pipeline. To aid in the stabilization of the apparatus on the pipeline forward and aft top rollers 108 and 110 are secured to the apparatus. The top rollers are journaled for rotation about a horizontal axis and are held in position by yoke 112 secured to a vertical shaft 114. The shaft 114 is adjustable vertically by being slideably received in telescopic sleeve 116. Each of the sleeve and the shaft are provided with operating bores 118 to receive suitable pins for maintaining the roller in a preselected telescopic position. The telescopic sleeve 116 is supported on the apparatus by top reinforcing bar 120 secured to the manifold 34 and a lower reinforcing bar 122 secured to the spine 37 extending parallel to the pipeline. The identical shape of the top rollers enable them to act as idler guide rollers on the top of the pipeline to center the apparatus on the pipeline and achieve the most effective drive engagement from the drive rollers.

CUTTING JETS

Figure 3:
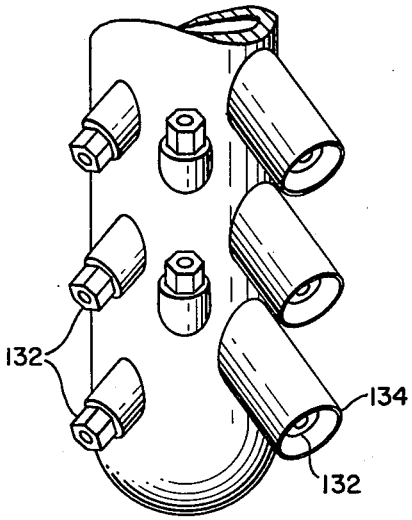
FIG. 3 is a perspective view partly broken away of the nozzle protectors and also showing the positioning of the nozzles.

In order to form the trench from the bottom formation the cutting jets 18 are secured to the frame as best shown in FIG. 2. The cutting jets are positioned to extend in stepwise fashion extending more deeply into the trench in the aft position of the jets on the apparatus. The forward pair of jets 124 are higher relative to the axis of the pipeline and preferably spaced apart more than the aft jets 126. The forward and aft cutting jets include jet heads 128 and 130 respectively formed from high pressure steel tubing. Each cutting head is provided with a plurality of jet nozzles 132. Each of these jet nozzles is angled downwardly from the axis of the jet head at least 45° and preferably approximately 50°–75° and most desirably 60° in order to minimize the rearward force vector from the reaction to the water jet. Similarly, there are as best shown in FIG. 3 a plurality of jet nozzles which are directed upwardly at an angle of 50°–75° from the axis of the jet head and preferably about 60° to offset the upward reaction force imparted to the apparatus by the water jet emerging from the downwardly directed nozzles. As best shown in FIG. 3 the nozzles may be positioned in vertical rows with adjacent nozzles in adjacent rows offset from each other. The number of vertical rows and the number of nozzles in each row are not critical but may vary from one to eight nozzles in a vertical row and one to eight or more vertical rows.

Also as best shown in FIG. 3 selected nozzles are provided with a protective means 134 around the nozzles. The protective means is in the form of a plurality of tubes secured to the jet head and extending substantially concentric with the nozzle 132 to protect the nozzles from striking the pipeline as the apparatus is being maneuvered into position over the pipeline.

Figure 5:
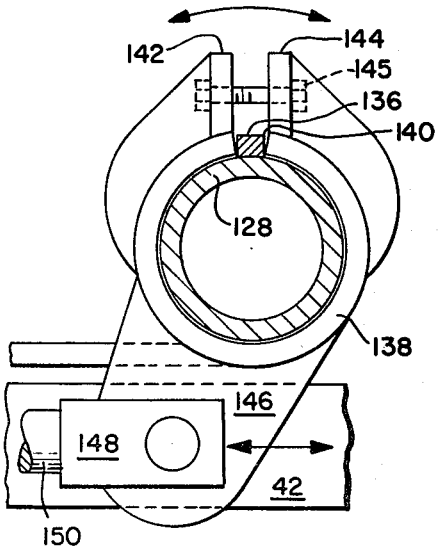
FIG. 5 is a cross-sectional view partly broken away taken along lines 5—5 of FIG. 2 showing the oscillating mechanism for oscillating the jet heads.

An important facet of the apparatus of the present invention is the incorporation of an oscillation capability for both the fore and aft jets 124 and 126. As will be seen best in FIGS. 2 and 5 the aft jet heads 126 are provided with a longitudinally extending fin 136 which extends down to about the position of the upper bar 42. The fin 136 is received for selected slideable movement within the sleeve 138 having longitudinal opening 140 to receive the fin 136. A pair of opposed ears 142 and 144 are secured to the sleeve 138 at the mouth of the opening 140 and abut the fin 136. Suitable securing means such as bolts 145 may be provided to maintain the ears 142 and 144 in abutting relationship with the fin 136 and yet upon release of the bolts permit the jet head 128 to be raised or lowered within the sleeve.

The sleeve is oscillated by means of arm 146 secured to the sleeve 138 at one end and at the other end pinned to a yoke 148 secured to piston rod 150 of ram 152. The ram 152 is suitably secured to the upper bar 42 in any suitable manner but as shown it is pinned to the side of gear box 106 which remains stationary with respect to upper bar 42. As shown the ram 152 is hydraulically operated with inlet and outlet means 154 and 156 respectively. The jet head 130 may be stabilized but permitted rotational movement by means of bearing 158 surrounding the jet head 130. The bearing 158 is provided with a longitudinal flange 160 having a plurality of position adjustment holes 162 to coincide with similar holes 164 and stabilizing plate 166 suitably secured to upper and lower bars 42 and 44.

The fore and aft jets 124 and 126 are interconnected by suitable linkage in the form of a bar 168 suitably secured by pivots 170 at either end to the jet heads 128 and 130 at 172. Forward jets 124 are secured for rotational movement by sleeve 174 into which the jet head 128 is received. Upper and lower bearing collars 176 and 178 hold the jet head in place within the sleeve. The jet head may be adjustable vertically by means of the flange 180 similar to flange 160 previously described also secured to stabilizing plate 182 secured to upright beam members 38. Suitable aligning holes 184 enable the plate 182 and flange 180 to be secured as by bolts not shown in order to raise and lower the jet head to accommodate different size trench depths.

The oscillation of the jets may be controlled in both period and sweep by any suitable manual control as shown generally at 186. The manual control of conventional pressure controller **186*a* can be used to vary the pressure of the fluid entering the conventional flow direction controller 186***b* which directs fluid into the inlet and outlet 154 and 156 thereby increasing or decreasing the period. It should be quite apparent that when higher pressure fluid of 1000–1200 psi is forced into the ram 152 that the action of the ram to move the rod 150 and therefore the sleeve 138 would be such as to induce much quicker movement in the piston rod 150 and therefore shorten the period of oscillation of the jet heads 130 and 128. Likewise very low pressure in the order of 200 psi would induce very slow movement of the piston rod to extend the period of oscillation substantially beyond that occurring at a high pressure of 1000 or 1200 psi.

The magnitude of the sweep of the oscillation of the jet heads is dependent upon the extent to which the rod 150 is moved by the entering and exiting fluid through inlet and outlet 154 and 156. The manual control can simply change the direction of the fluid flow in inlet and outlet 156 as desired to attain the full extension of rod 150 out of the ram 152 or limit the telescoping of the rod into the ram cylinder of the ram 152 depending upon the amplitude desired all of which can be easily mechanically controlled by the conventional flow direction controller means.

EDUCTORS AND CUTTINGS DISPERSAL MEANS

The eductors 20 are positioned both forward and aft the apparatus as shown in FIGS. 1 and 2. The aft eductors 188 and 190 are each in the form of a long tubular member. The lower end of the eductor is provided with an opening 192 which faces in the direction of the forward motion at the opposite end of the tubular member forming the eductor. A flexible hose 194 is positioned to disperse the cuttings as they rise in the eductor due to the cutting dispersal means 22 and 24. The eductor is suitably secured with complementary flanges 195 and 196 to the upright beam member 40.

Figure 4:
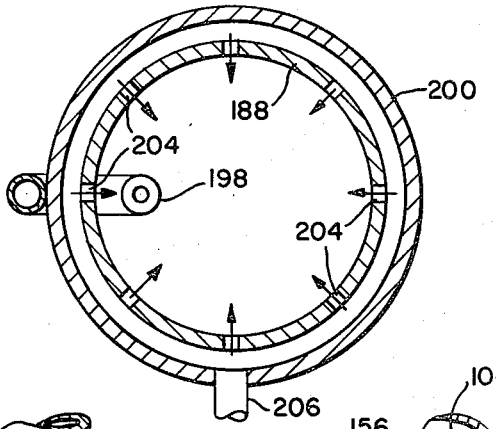
FIG. 4 is a cross-sectional view taken along lines 4—4 of FIG. 2 and showing the cuttings dispersal means in the form of an air lift ring means surrounding the eductor.

The cuttings dispersal means includes both the jet means 22 and the air lift means 24. The jet means 22 as best shown in FIG. 4 includes a water pipe having a nozzle 198 extending upwardly within the interior of the tubular conduit 188 forming the eductor. The jet nozzle 198 delivers a high pressure jet stream in an upward direction which prevents the clogging of the mouth or opening 192 of the eductor.

The air dispersal ring 24 is in the form of an air inlet positioned within the conduit 188 forming the eductor. As best shown in FIG. 4 the air inlet means includes an airlift ring 200 secured to the outside of the conduit 188. The air lift ring forms a collar housing a concentric duct around the conduit to provide fluid communication to the interior of the conduit through a plurality of inlet ports 204. Suitable hose connection 206 is provided to extend to the manifold 34 to provide the air for lifting the cuttings. The air lift rings depends upon the flow of air rising to the surface through the conduit 188 to create suction for the cuttings into the mouth 192. The air pressure supplied to the air lift ring 200 is not critical as any air pressure supply would rise in the conduit and create the necessary suction. Higher air pressure, however, would increase the suction effect.

The forward eductor 207 is positioned on top of the pipeline P as best shown in FIG. 2. This eductor leads the apparatus and removes cuttings and possible cave-ins that may have occurred. The eductor is preferably secured to the front roller shaft by connector 207*a* and to the telescopic sleeve 116 by a similar connector 207*b* to the sleeve 207*c* around the eductor to permit slideable movement thereof. The eductor 207 will therefore move vertically when roller 108 is vertically adjusted.

This leading eductor is particularly advantageous when making a second pass over the same area previously cut but which resulted in a cave-in. The eductor so positioned uniquely in the front of the apparatus will remove the cave-in and not require the apparatus to stop prematurely.

A jet head 209 with jet nozzles 132 may optionally be positioned in front of the forward eductor 207 to aid in maintaining a clear path.

SHROUD

The shroud 30 is best shown in FIGS. 1 and 2. The shroud constitutes a housing substantially surrounding the frame 16 and the drive rollers 26 and 28 formed from a pair of fore and aft plates 208 and 210 firmly secured to the frame members 32 in any suitable manner such as by welding. A cap or top 216 is secured to the fore and aft plates 208 and 210 and side plates 212 and 214 to form an inverted closure or housing. A plurality of outlets 218 are provided in the cap 216 to which is secured outlet 220 for disposal of the cuttings. An air lift ring 200 as previously described may be used to surround the outlet tubing 220. Optionally, a simple air lift pipe 222 having outlet 224 may be positioned at the outlet 218 to aid in the removal of the cuttings.

The purpose of the shroud is to confine the cuttings to the area housed within the shroud for its removal by the outlet 220 for dispersal at a distance from the trench. The shroud, though optional in this apparatus, has been found to effect a more efficient disposal of the cuttings and prevent the cuttings from falling back into the trench before the pipeline is laid at the bottom of the trench.

BUOYANCY TANKS

The buoyancy tanks 12 and 14 are important to the attitude and position of the apparatus on the pipeline. The buoyancy tanks are secured to the apparatus by cradle struts 226 partially surrounding the buoyancy tanks and extending downwardly to support carriage 228. The support carriage 228 is secured to an elongated sleeve which is received for slideable movement on a pair of posts 232 secured to the air manifold 34. The posts 232 and the slideable sleeves 230 are provided with a complementary bores 236 and 238 so that the buoyancy tanks with their cradle can be positioned by reason of slideable movement of the sleeve 230 vertically on the posts. The vertical movement of the buoyancy tanks 212 and 214 permit the apparatus to avoid the possibility of the buoyancy tanks 212 and 214 for the cradle 226 from striking the sides of the trench to cause cave-in of the trench before the pipeline is buried at the bottom of the trench.

The buoyancy tanks may be of any design, construction and preferably have water inlets at the bottom shown at 240 and air inlets at the top as shown at 242. The air inlets 242 may be connected to the manifold 34 to supply the air necessary to control the buoyancy of the tanks.

OPERATION

The present underwater trenching apparatus is designed to create a trench T by cutting the formation from the bottom B to the body of water. The present apparatus is self-propelled by the drive rollers 26 and 28 which are engaged with the pipeline in a driving relationship. When the apparatus comes upon an obstruction in the pipeline such as an anode the apparatus is not able to pass over the anode. The apparatus then must be operated to open and close the frame by means of the rams 86 and 88 when used alternately. For instance, upon activation of ram 86 the fore portion of the frame members including forward upright beam member 38 pivot about pivot shaft 48 while upper and lower bars and their fore sections 54 and 58 pivot about the journal 52 to disengage the forward drive rollers 26 from the pipeline. The aft ram 88 remains closed to tightly engage the aft drive rollers 28 in engagement with the pipeline in order to move the apparatus forwardly to a point where the forward drive rollers 26 have passed over the obstruction. The forward rams 86 are then closed to engage the forward drive rollers 26 with the pipeline and the aft ram 88 is open to disengage the aft drive rollers 28 from the pipeline. Forward drive rollers 26 are powered to move the apparatus forwardly so that aft drive rollers 28 pass over the obstruction at which time aft ram 88 is closed to again engage aft drive rollers 28 in driving relationship with the pipeline. The oscillating jet nozzles are effective to cut the trench by controlling the period and sweep of the nozzles. In a soft, sandy formation the period may be manually controlled and be of short duration due to the fact that the jet nozzles 132 would easily cut a path in the yielding formation. The sweep of the oscillating jet heads 128 and 130 should be the maximum to cut the widest trench in order to prevent cave-in. For harder formation, the reverse is generally true, all of which may be controlled manually at the surface by the operator.

It should be apparent that the objects of the present invention have been met and the scope of the invention should be limited solely by the dependent claims.

I claim:

1. An underwater trenching apparatus for burying pipeline and the like comprising:

a frame for positioning about the pipeline to be buried, said frame including frame members positioned on each side of said pipeline, roller means connected to at least one of said frame members for engagement with said pipeline, and cutting means secured to said apparatus for cutting a trench in a formation and having oscillating means connected thereto for oscillating the cutting means along a stationary vertical axis positioned on the pipeline side of the frame and in accordance with a preselected period and sweep.

2. The underwater trenching apparatus of claim 1 including, said cutting means being water jet nozzles to spray streams of water into the formation.

3. The underwater trenching apparatus of claim 2 including, said cutting means having pairs of elongated jet heads extending on each side of said frame and supporting said jet nozzles.

4. The underwater trenching apparatus of claim 3 including, said oscillating means including connecting means secured to each jet head to oscillate said jet heads and said nozzles.

5. The underwater trenching apparatus of claim 4 including, said connecting means including linkage means connecting adjacent jet heads to oscillate said jet heads and said nozzles.

6. The underwater trenching apparatus of claims 1, 2, 3 4 or 5 including, said oscillating means including control means to control the period and sweep of the oscillation of said heads.

7. The underwater trenching apparatus of claim 6 including, said control means including pressure variation means and flow direction means.

8. The underwater trenching apparatus of claim 3 including, said jet head having a radially outwardly extending rib, said connecting means operatively receiving said rib for oscillating movement therewith.

9. The underwater trenching apparatus of claim 8 including, said connecting means being operatively connected to said oscillating means and having a slideable relationship with said rib.

10. An underwater trenching apparatus for burying pipeline and the like comprising:

a frame for positioning about the pipeline to be buried, said frame including frame members positioned on each side of said pipeline, drive roller means connected to at least one of said frame members for engagement with said pipeline, pivot means positioned on said frame for pivoting said frame members about a substantially horizontal axis parallel to said pipeline transversely toward and away from roller engagement with said pipeline, journal means operatively connected to at least one frame member for limited rotational movement about an axis substantially perpendicular to said pipeline, power means on said apparatus for moving said frame members about said axes, and cutting means secured to said apparatus for cutting a trench in a formation.

11. The underwater trenching apparatus of claim 10 including, said journal means being positioned intermediate the ends of at least one frame member forming sections thereof to permit one section of said frame member to move transversely of the axis of said pipeline.

12. The underwater trenching apparatus of claim 11 including, at least one of said frame members having a fore roller of said drive roller means secured to a fore section of said frame member and an aft roller of said drive roller means secured to said aft section of said frame member.

13. The underwater trenching apparatus of claim 12 including, said power means being operative to selectively move said fore and aft sections about said journal axis to selectively engage or disengage the respective one of said fore and aft rollers with a driving relationship to said pipeline.

14. The underwater trenching apparatus of claim 10 including, said frame member having said journal means being formed of fore and aft sections rotatable about said journal means.

15. The underwater trenching apparatus of claim 14 including, each said fore and aft sections having respectively fore and aft drive rollers of said drive roller means for selective drive engagement with said pipeline.

16. The underwater trenching apparatus of claim 15 including, said power means being operative to selectively move said fore and aft sections about said journal axis to selectively engage or disengage the respective one of said fore and aft rollers with a driving relationship to said pipeline.

17. The underwater trenching apparatus of claims 10, 11, 12, 13, 14, 15 or 16 including, said journal means including abutment means positioned said fore and aft sections.

18. An underwater trenching apparatus for burying pipeline and the like comprising:

a frame for positioning about the pipeline to be buried, said frame including frame members positioned on each side of said pipeline, drive roller means connected to at least one of said frame members for engagement with said pipeline, cutting means secured to said apparatus for cutting a trench in a formation for burying said pipeline, and a shroud housing secured to said apparatus and positioned above said pipeline and extending down adjacent to said pipeline to collect cuttings from said cutting means and permit disposal thereof.

19. The underwater trenching apparatus of claim 18 including, said shroud housing having at least one outlet for said cuttings positioned above the bottom of said pipeline.

20. The underwater trenching apparatus of claim 19 including, said outlet being powered by suction means and positioned above said pipeline.

21. The underwater trenching apparatus of claims 18, 19, 20 including, said shroud housing positioned above and extending substantially adjacent to the bottom of said frame.

22. The underwater trenching apparatus of claims 19, 20, including, said shroud housing having a top and vertically depending side substantially surrounding said frame and said outlet being positioned at the top.

23. The underwater trenching apparatus of claims 19, 20, including, a conduit being connected to each said outlet and extending about said housing and an air inlet means positioned within said conduit for injecting air into said conduit away from said outlet for removal of the cuttings.

24. The underwater trenching apparatus of claim 23 including, said air inlet means including an air lift ring means for injecting air up said conduit to aid in withdrawal of said cuttings.

25. The underwater trenching apparatus of claim 24 including, said air lift ring means including a plurality of inlet ports positioned around and in fluid communication with said conduit.

26. The underwater trenching apparatus of claim 24 including, said air lift ring comprising a collar housing a concentric duct substantially surrounding said conduit and a plurality of inlet ports formed in said conduit for fluid communication with said duct and said conduit and means supplying air to said air lift ring for injection into said conduit.

27. An underwater trenching apparatus for burying pipeline and the like comprising:

a frame for positioning about the pipeline to be buried, said frame including frame members positioned on each side of said pipeline, roller means connected to at least one of said frame members for engagement with said pipeline, cutting means secured to said apparatus for cutting a trench in a formation to enable said pipeline to be buried, and eductor means including a conduit secured to said apparatus and positioned above said pipeline and forward of said cutting means for collecting and disposal of cuttings in front of said apparatus.

28. The underwater trenching apparatus of claim 27 including, said eductor means being positioned to lead said apparatus.

29. The underwater trenching apparatus of claim 27, 28 including, a foremost guide roller positioned in front of said frame and in contact with said pipeline, mounting means secured to said frame for receiving said foremost guide roller for vertically slideable movement, said mounting means and said foremost guide roller being positioned aft of said eductor means.

30. The underwater trenching apparatus of claim 29 including, said eductor means being connected to said foremost guide roller for adjustable vertical movement within said mounting means.

31. The underwater trenching apparatus of claims 27, 28, including, an air inlet means positioned within said conduit for injecting air into said conduit for removal of the cuttings.

32. The underwater trenching apparatus of claim 31 including, said air inlet means including an air lift ring means for injecting air up said conduit to aid in withdrawal of said cuttings.

33. The underwater trenching apparatus of claim 31 including, said air lift ring means including a plurality of inlet ports positioned around and in fluid communication with said conduit.

34. The underwater trenching apparatus of claim 32 including, said air lift ring comprising a collar housing a concentric duct substantially surrounding said conduit and a plurality of inlet ports formed in said conduit for fluid communication with said duct and said conduit and means supplying air to said air lift ring for injection into said conduit.

35. An underwater trenching apparatus for burying pipeline and the like comprising:

a frame for positioning about the pipeline to be buried, said frame including frame members positioned on each side of said pipeline, roller means connected to at least one of said frame members for engagement with said pipeline, cutting means secured to said apparatus for cutting a trench in a formation to enable said pipeline to be buried, eductor means including a conduit secured to said apparatus, cuttings dispersal means communicating with said eductor means to permit removal of said cuttings by said eductor.

36. The underwater trenching apparatus of claim 35 including, said cuttings dispersal means comprising a water jet nozzle means in communication with said conduit to prevent clogging of said eductor means.

37. The underwater trenching apparatus of claim 36 including, said water jet nozzle being positioned at the bottom of the eductor to direct a jet of water upwardly.

38. The underwater trenching apparatus of claim 35, 36 including, said water jet nozzle being positioned at the mouth of the eductor to break large cuttings for disposal by said eductor.

39. The underwater trenching apparatus of claims 35, 36, 37, 55 including, said cuttings dispersal means comprising an air inlet means positioned within said conduit for injecting air into said conduit away from said outlet for removal of the cuttings.

40. The underwater trenching apparatus of claim 39 including, said air inlet means including an air lift ring means for injecting air up said conduit to aid in withdrawal of said cuttings.

41. The underwater trenching apparatus of claim 39 including, said pair lift ring means including a plurality of inlet ports positioned around and in fluid communication with said conduit.

42. The underwater trenching apparatus of claim 40 including, said air lift ring comprising a collar housing a concentric duct substantially surrounding said conduit and a plurality of inlet ports formed in said conduit for fluid communication with said duct and said conduit and means supplying air to said air lift ring for injection into said conduit.

43. An underwater trenching apparatus for burying pipeline and the like comprising:

a frame for positioning about the pipeline to be buried, said frame including frame members positioned on each side of said pipeline, roller means connected to at least one of said frame members of engagement with said pipeline, cutting means secured to said apparatus for cutting a trench in a formation to enable said pipeline to be buried, and buoyancy means for stabilizing said apparatus, support means operatively connecting said frame to said buoyancy means for selected vertical movement of said buoyancy means relative to said frame.

44. The underwater trenching apparatus of claim 43 or 57 including, said support means comprising a slide means connected between said frame and said buoyancy means to permit the vertical movement of the buoyancy means to avoid contact with the sides of the trench.

45. In an underwater trenching apparatus for burying pipeline under abody of water having a frame for positioning about the pipeline to be buried, said frame including frame members positioned on each side of said pipeline, roller means connected to at least one of said frame members for engagement with said pipeline and cutting means including jet heads and a plurality of jet nozzles thereon secured to said apparatus for cutting a trench in a formation and eductor means for removing cuttings the improvement comprising, said jet nozzles having protective means extending outwardly beyond the tips of selected nozzles.

46. The underwater trenching apparatus of claim 45 including, said protective means surrounding said selected nozzles without interfering with the jet flow from said nozzles.

47. The underwater trenching apparatus of claim 45 including, said protective means being a tubular extension substantially concentric with said selected nozzles.

48. An underwater trenching apparatus for burying pipeline and the like comprising:

a frame for positioning about the pipeline to be buried, said frame including frame members positioned on each side of said pipeline, drive roller means connected to at least one of said frame members for engagement with said pipeline, pivot means positioned on said frame for pivoting said frame members about a substantially horizontal axis parallel to said pipeline transversely toward and away from roller engagement with said pipeline, journal means operatively connected to at least one frame member for limited rotational movement about an axis substantially perpendicular to said pipeline, power means on said apparatus for moving said frame members about said axes, cutting means secured to said apparatus for cutting a trench in a formation and having oscillating means connected thereto for oscillating the cutting means in accordance with a preselected period and sweep.

49. The underwater trenching apparatus of claim 48 including, said journal means being positioned intermediate the ends of at least one frame member forming sections thereof to permit one section of said frame member to move transversely of the axis of said pipeline.

50. The underwater trenching apparatus of claim 48 including, at least one of said frame members having a fore roller of said drive roller means secured to a fore section of said frame member and an aft roller of said drive roller means secured to said aft section of said frame member.

51. The underwater trenching apparatus of claim 50 including, said power means being operative to selectively move said fore and aft sections about said journal axis to selectively engage or disengage the respective one of said fore and aft rollers with a driving relationship to said pipeline.

52. An underwater trenching apparatus for burying pipeline and the like comprising:

a frame for positioning about the pipeline to be buried, said frame including frame members positioned on each side of said pipeline, roller means connected to at least one of said frame members for engagement with said pipeline, cutting means secured to said apparatus for cutting a trench in a formation and having oscillating means connected thereto for oscillating the cutting means in accordance with a preselected period and sweep, and a shroud housing secured to said apparatus and positioned above said pipeline and extending down adjacent to said pipeline to collect cuttings from said cutting means and permit disposal thereof.

53. The underwater trenching apparatus of claim 52 including, said shroud housing having at least one outlet for said cuttings positioned above the bottom of said pipeline.

54. An underwater trenching apparatus for burying pipeline and the like comprising:

a frame for positioning about the pipeline to be buried, said frame including frame members positioned on each side of said pipeline, drive roller means connected to at least one of said frame members for engagement with said pipeline, pivot means positioned on said frame for pivoting said frame members about a substantially horizontal axis parallel to said pipeline transversely toward and away from roller engagement with said pipeline, journal means operatively connected to at least one frame member for limited rotational movement about an axis substantially perpendicular to said pipeline, power means on said apparatus for moving said frame members about said axes, cutting means secured to said apparatus for cutting a trench in a formation, and eductor means secured to said apparatus and positioned above said pipeline and forward of said cutting means for collecting cuttings forward of said apparatus.

55. An underwater trenching apparatus for burying pipeline and the like comprising:

a frame for positioning about the pipeline to be buried, said frame including frame members positioned on each side of said pipeline, drive roller means connected to at least one of said frame members for engagement with said pipeline, pivot means positioned on said frame for pivoting said frame members about a substantially horizontal axis parallel to said pipeline transversely toward and away from roller engagement with said pipeline, journal means operatively connected to at least one frame member for limited rotational movement about an axis substantially perpendicular to said pipeline, power means on said apparatus for moving said frame members about said axes, cutting means secured to said apparatus for cutting a trench in a formation, and eductor means including a conduit secured to said apparatus, cuttings dispersal means communicating with said eductor means to permit removal of said cuttings by said eductor.

56. The underwater trenching apparatus of claim 55 including, said cuttings dispersal means comprising a water jet nozzle means in communication with said conduit to prevent clogging of said eductor means.

57. The underwater trenching apparatus of claim 10 including, buoyancy means for stabilizing said apparatus, support means operatively connecting said frame to said buoyancy means for selected vertical movement of said buoyancy means relative to said frame.

58. The underwater trenching apparatus of claim 10 including, eductor means including a conduit secured to said apparatus, cuttings dispersal means communicating with said eductor means to permit removal of said cuttings by said eductor.

59. The underwater trenching apparatus of claim 1 including, eductor means secured to said apparatus and positioned above said pipeline and forward of said cutting means for collecting cuttings forward of said apparatus.

60. The underwater trenching apparatus of claim 27, including, eductor means including a conduit secured to said apparatus, cuttings dispersal means communicating with said eductor means to permit removal of said cuttings by said eductor.

61. The underwater trenching apparatus of claim 27 including, a shroud housing secured to said apparatus and positioned above said pipeline and extending down adjacent to said pipeline to collect cuttings from said cutting means and permit disposal thereof.

62. The underwater trenching apparatus of claim 1 including, cutting means secured to said apparatus for cutting a trench in a formation, and eductor means including a conduit secured to said apparatus, cuttings dispersal means communicating with said eductor means to permit removal of said cuttings by said eductor.

63. The underwater trenching apparatus of claim 1, including, cutting means secured to said apparatus for cutting a trench in a formation, eductor means including a conduit secured to said apparatus, cuttings dispersal means communicating with said eductor means to permit removal of said cuttings by said eductor, and eductor means secured to said apparatus and positioned above said pipeline and forward of said cutting means for collecting cuttings forward of said apparatus.

64. The underwater trenching apparatus of claim 1, including, cutting means secured to said apparatus for cutting a trench in a formation, eductor means including a conduit secured to said apparatus, cuttings dispersal means communicating with said eductor means to permit removal of said cuttings by said eductor, eductor means secured to said apparatus and positioned above said pipeline and forward of said cutting means for collecting cuttings forward of said apparatus, and buoyancy means for stabilizing said apparatus, support means operatively connecting said frame to said buoyancy means for selected vertical movement of said buoyancy means relative to said frame.

65. The underwater trenching apparatus of claim 1 including, cutting means secured to said apparatus for cutting a trench in a formation, eductor means including a conduit secured to said apparatus, cuttings dispersal means communicating with said eductor means to permit removal of said cuttings by said eductor, eductor means secured to said apparatus and positioned above said pipeline and forward of said cutting means for collecting cuttings forward of said apparatus, buoyancy means for stabilizing said apparatus, support means operatively connecting said frame to said buoyancy means for selected vertical movement of said buoyancy means relative to said frame, and a shroud housing secured to said apparatus and positioned above said pipeline and extending down adjacent to said pipeline to collect cuttings from said cutting means and permit disposal thereof.

* * * * *